US007572191B2

(12) United States Patent
Weston et al.

(10) Patent No.: US 7,572,191 B2
(45) Date of Patent: Aug. 11, 2009

(54) INTERACTIVE WATER PLAY APPARATUS AND METHODS

(75) Inventors: Denise C. Weston, Wakefield, RI (US); Rick A. Briggs, Springfield, IL (US)

(73) Assignee: Creative Kingdoms, LLC, Springfield, IL (US)

( * ) Notice: Subject to any disclaimer, the term of this patent is extended or adjusted under 35 U.S.C. 154(b) by 88 days.

(21) Appl. No.: 11/735,222

(22) Filed: Apr. 13, 2007

(65) Prior Publication Data

US 2007/0249425 A1 Oct. 25, 2007

Related U.S. Application Data

(60) Provisional application No. 60/792,023, filed on Apr. 14, 2006.

(51) Int. Cl.
*A63H 23/10* (2006.01)
*A63G 31/00* (2006.01)

(52) U.S. Cl. ..... 472/128; 446/153; 273/109

(58) Field of Classification Search ..... 472/117, 472/128, 129; 446/153, 156, 159, 168; 273/109, 273/112 L, 121 D, 121 E, 122 R
See application file for complete search history.

(56) References Cited

U.S. PATENT DOCUMENTS

| | | | | | |
|---|---|---|---|---|---|
| 2,001,366 | A | | 5/1935 | Mittelman | |
| 2,752,725 | A | * | 7/1956 | Unsworth | 446/166 |
| 2,902,023 | A | | 9/1959 | Waller | |
| 3,135,512 | A | * | 6/1964 | Taylor | 273/109 |
| 3,633,904 | A | | 1/1972 | Kojima | |
| 4,055,341 | A | | 10/1977 | Martinez | |
| 4,153,250 | A | | 5/1979 | Anthony | |
| 4,175,665 | A | * | 11/1979 | Dogliotti | 211/59.2 |
| 4,205,785 | A | | 6/1980 | Stanley | |
| 4,595,369 | A | * | 6/1986 | Downs | 434/302 |
| 4,750,733 | A | | 6/1988 | Foth | |
| 4,932,917 | A | | 6/1990 | Klitsner | |
| 4,960,275 | A | | 10/1990 | Magon | |
| 5,114,344 | A | | 5/1992 | Fumagalli et al. | |
| 5,194,048 | A | | 3/1993 | Briggs | |

(Continued)

FOREIGN PATENT DOCUMENTS

| | | |
|---|---|---|
| WO | WO 90/07961 | 7/1990 |

(Continued)

*Primary Examiner*—Kien T Nguyen
(74) *Attorney, Agent, or Firm*—Knobbe, Martens, Olson & Bear, LLP

(57) ABSTRACT

An interactive play structure is provided for facilitating team-oriented and/or group play to achieve a desired effect. The play structure includes play elements disposed at various locations and elevations throughout the play structure. Each play element can be activated or operated by one or more play participants to complete steps in a chain of triggering events. The overall completion of the chain of events results in a desired result or effect, such as a domino-like cascade of various mechanisms, balls, water the like. In one example, the effect includes the release of a cannonball from the top of a vertical structure. As the cannonball reaches the end of its descent, it causes water to be radially dispersed from a pool, such as onto nearby play participants. The cannonball is then advantageously returned to the top of the vertical structure through the use of one or more return conduits.

20 Claims, 12 Drawing Sheets

U.S. PATENT DOCUMENTS 5,378,197 A 1/1995 Briggs
5,393,074 A 2/1995 Bear et al.
5,405,294 A 4/1995 Briggs
5,421,575 A * 6/1995 Triner ..... 273/109
5,439,199 A 8/1995 Briggs et al.
5,443,261 A 8/1995 Lee et al.
5,452,893 A 9/1995 Faulk et al.
5,482,510 A 1/1996 Ishii et al.
5,580,319 A 12/1996 Hamilton
5,649,867 A 7/1997 Briggs
5,662,525 A 9/1997 Briggs
5,667,217 A 9/1997 Kelly et al.
5,741,189 A 4/1998 Briggs
5,820,471 A 10/1998 Briggs
5,820,472 A 10/1998 Briggs
5,836,817 A 11/1998 Acres et al.
5,853,332 A 12/1998 Briggs
5,855,483 A 1/1999 Collins et al.
5,865,680 A 2/1999 Briggs
5,924,695 A 7/1999 Heykoop
5,942,969 A 8/1999 Wicks
5,957,779 A 9/1999 Larson
5,967,901 A 10/1999 Briggs
6,089,987 A 7/2000 Briggs
6,129,549 A 10/2000 Thompson
6,132,318 A 10/2000 Briggs
6,174,242 B1 1/2001 Briggs et al.
6,186,902 B1 2/2001 Briggs
6,210,287 B1 4/2001 Briggs
6,220,965 B1 4/2001 Hanna et al.
6,231,451 B1 5/2001 Briggs
6,234,803 B1 5/2001 Watkins
6,254,101 B1 7/2001 Young
6,264,202 B1 7/2001 Briggs
6,273,425 B1 8/2001 Westfall et al.
6,276,353 B1 8/2001 Briggs et al.
6,283,871 B1 9/2001 Briggs
6,352,478 B1 3/2002 Gabai et al.
6,375,578 B1 4/2002 Briggs
6,386,538 B1 5/2002 Mejia
6,527,646 B1 3/2003 Briggs
6,569,023 B1 5/2003 Briggs
6,634,949 B1 10/2003 Briggs et al.
6,651,268 B1 11/2003 Briggs
6,682,074 B2 1/2004 Weston
6,725,107 B2 4/2004 MacPherson
6,746,334 B1 6/2004 Barney
6,761,637 B2 7/2004 Weston et al.
6,786,830 B2 9/2004 Briggs et al.
6,796,908 B2 9/2004 Weston
6,967,563 B2 11/2005 Bormaster
6,967,566 B2 11/2005 Weston et al.
7,029,400 B2 4/2006 Briggs
2002/0032067 A1 3/2002 Barney
2003/0073505 A1 4/2003 Tracy
2003/0190967 A1 10/2003 Henry
2004/0033833 A1 2/2004 Briggs et al.
2004/0077423 A1 4/2004 Weston et al.
2005/0138851 A1 6/2005 Ingraselino
2006/0229134 A1 10/2006 Briggs et al.

FOREIGN PATENT DOCUMENTS

WO WO 96/14121 5/1996

* cited by examiner

INTERACTIVE WATER PLAY APPARATUS AND METHODS

REFERENCE TO RELATED APPLICATION

The present application claims the benefit of priority under 35 U.S.C. § 119(e) of U.S. Provisional Application No. 60/792,023, filed on Apr. 14, 2006, and entitled "INTERACTIVE WATERPLAY APPARATUS AND METHODS," the entirety of which is hereby incorporated herein by reference to be considered part of this specification.

BACKGROUND OF THE INVENTION

1. Field of the Invention

Embodiments of the invention relate generally to play apparatus and methods and, in particular, to interactive water play for an amusement park, water park or the like.

2. Description of the Related Art

Recent years have seen a proliferation of commercial play structures that provide an exciting alternative to traditional parks and playgrounds. Certain play structures include multiple play areas or stations in which participants may engage in educational and/or interactive activities. For instance, many play structures include ball pits, ropes, ladders, water guns, and the like.

Moreover, certain amusement parks have incorporated water-oriented themes and structures that provide people with an option to temporarily escape from uncomfortably hot conditions. Such parks often offer a fun environment for the participants, observers and others. For instance, certain water parks include waterslides, wave pools and the like.

SUMMARY OF THE INVENTION

In light of the foregoing, a need exists for water play apparatus and methods that provide an interactive environment for play participants. For example, a need exists for a water play apparatus that allows play participants to optionally compete and/or work with each other to achieve at least one water effect, such as a cannonball effect.

In certain embodiments, a water play structure is disclosed comprising a cannonball, or other projectile, that is configured to cause a wave or splash of water when activated. For instance, in certain embodiments, a vertical structure provides a path through which a cannonball-like object falls into a pool of water, thereby creating a water effect that can involve a plurality of play participants.

In certain embodiments, an interactive play structure is provided for facilitating team-oriented or group interactive play to achieve a common desired effect. The play structure can include a number of play elements disposed at various locations and elevations throughout the play structure. In certain embodiments, each play element can be activated or operated by one or more play participants to complete one of several steps in a process of triggering one or more events. For example, play participants can work to activate a cannonball-like effect.

For instance, in certain embodiments, a chain of triggering events results in energy being transferred from one play element to the next. The overall completion of the chain of events results in a common desired result or effect, such as a domino-like cascade of various mechanisms, balls, water and/or the like. In certain embodiments, play participants can achieve the final goal through a collective team effort requiring the coordinated completion of several smaller objectives comprising each step in the chain of triggering events.

In certain embodiments, a three-dimensional endoskeletal or exoskeletal structure is disclosed that performs as a play element and/or houses a multiplicity of other water and/or non-water play elements. For example, such a structure can provide omni-directional orientation of water effects and/or create a myriad of changeable classes of water effects. Advantages of such an attraction are numerous, and large scale, high-capacity participatory water play for amusement facilities and public parks is made possible.

In some embodiments of the invention, an interactive water play apparatus comprises a plurality of play media, a guide structure configured to guide or direct the play media, a water effect and a plurality of control modules configured to interact with the guide structure to alter the guiding of at least one of the play media to activate the water effect.

In certain embodiments, the interactive water play apparatus further includes one or more water effects, diversion mechanisms or other features that participants are permitted to optionally control. In some arrangements, participants interactively control one or more play media members by operating a lever, hand wheel or other suitable actuation device. In yet other embodiments, participants can interactively control the play media members using one or more electrical methods.

In one arrangement, an auger or other suitable mechanical or pneumatic device is used to move play media members within the guide structure. In certain embodiments, the guide structure is arranged such that gravity assists in moving one or more of the play media through the guide structure.

In certain embodiments, the interactive water play apparatus is configured to permit play participants to compete against one another. For example, prevailing participants can be awarded prizes, points or with additional operational control of one or more water effects or other interactive aspect(s) of the apparatus.

In certain embodiments, an apparatus is disclosed for providing water play entertainment to one or more play participants. The apparatus comprises: an elongated substantially vertical structure having a top portion and a bottom portion and a substantially vertical guide extending therebetween; a water play effect located proximate to the bottom portion of the elongated substantially vertical structure; and a projectile configured to enter the elongated substantially vertical structure at the top portion and descend through the substantially vertical guide to the bottom portion, the projectile being further configured to activate the water play effect when near the bottom portion of the elongated substantially vertical structure. In certain embodiments, the projectile comprises a substantially spherical object, a cannonball, a non-spherical object, a figure or the like. In certain further embodiments, the apparatus includes a return conduit configured to transport the projectile from the bottom portion of the elongated substantially vertical structure to the top portion of the elongated substantially vertical structure following the descent of the projectile.

In certain embodiments, a method is disclosed for providing an interactive water play apparatus. The method comprises: providing a plurality of play media; providing one or more guide elements configured to guide each of the plurality of play media along a travel path; providing a water effect having a cannonball object; and providing at least one user-interactive control module communicatively coupled to the one or more guide elements to, based at least upon one or more actions of a user, alter the travel path of at least one of the plurality of play media to release the cannonball to activate the water effect.

In certain embodiments, a water play apparatus is disclosed that comprises: means for containing water; means for displacing the water from said containing means; and means for defining a substantially vertical guide substantially above said containing means, wherein said displacing means is configured to descend from a first portion of said defining means and through said defining means to the containing means. In certain embodiments, the water play apparatus further comprises means for returning said displacing means to the first portion of said defining means after a descent of said displacing means.

For purposes of summarizing the disclosure, certain aspects, advantages and novel features of the inventions have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

FIG. 7A illustrates a perspective view of the cannonball apparatus during a pre-fall stage, FIG. 7B illustrates a perspective view of the cannonball apparatus during a fall stage, and FIG. 7C illustrates a perspective view of the cannonball apparatus in a final or splash stage.

DETAILED DESCRIPTION OF THE PREFERRED EMBODIMENTS

As will be understood from the disclosure herein, certain embodiments of the invention advantageously provide a fun and entertaining interactive play structure that not only stimulates the development of creative thinking and individual problem solving abilities but also fosters and encourages group cooperation and team work to achieve a common goal. For instance, certain embodiments provide an interactive play structure that allows play participants to experiment with and learn about various cause and effect reactions using a combination of familiar and entertaining play mediums in a manner that encourages and rewards group cooperation and teamwork to achieve a common goal.

In certain embodiments, an interactive play structure is disclosed that combines various elements and aspects of both wet and dry play structures in order to afford possibilities for play activities that incorporate a wide range of fun and exciting play media and mechanisms, such as balls, water, valves, springs, cams, pulleys, gears, cogs, baskets, buckets, water/air-powered devices, combinations of the same or the like, each of which can be employed to provide an interactive play experience that is both fun and educational.

In certain embodiments of the invention, an interactive play structure is disclosed for facilitating team-oriented or group interactive play to achieve a common goal. The play structure can include a number of play elements disposed at various locations and elevations throughout the play structure. Each play element can be activated or operated by one or more play participants to complete one of several steps in a chain of triggering events in which kinetic energy is transferred from one play element to the next. In certain embodiments, the overall completion of the chain of events results in a common desired result or effect, such as the release of a "cannonball" and/or a domino-like cascade of various mechanisms, balls, water, combinations of the same or the like. Play participants can work to achieve a final goal through a collective team effort requiring the coordinated completion of several smaller objectives comprising each step in the chain of triggering events.

The features of embodiments of the apparatus and methods will now be described with reference to the drawings summarized above. Throughout the drawings, reference numbers are re-used to indicate correspondence between referenced elements. The drawings, associated descriptions, and specific implementation are provided to illustrate embodiments of the invention and not to limit the scope of the disclosure. It is also to be understood that the drawings are for the purpose of illustrating concepts of embodiments of the invention and may not be to scale.

Figure 1:
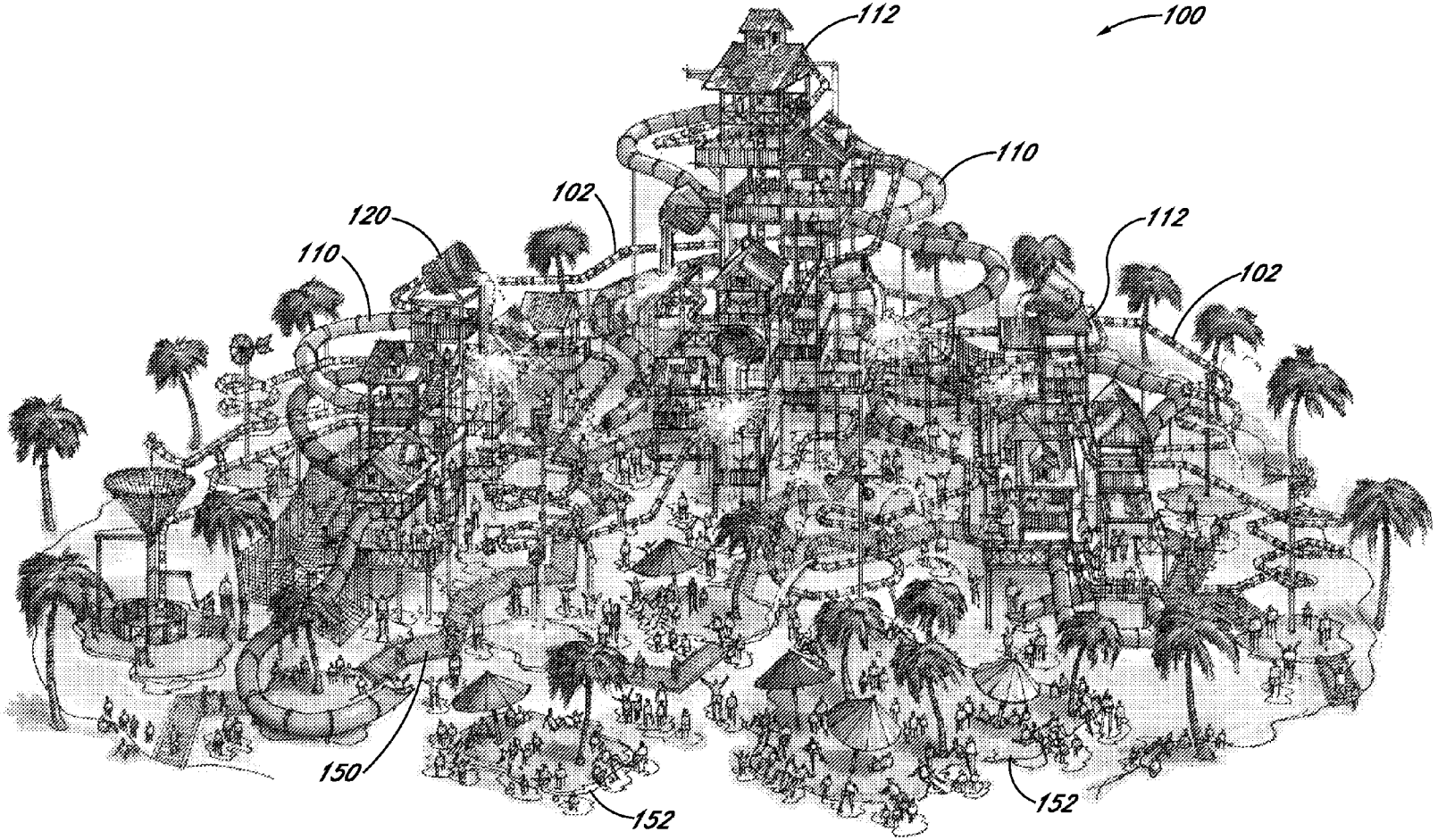
FIG. 1 illustrates a perspective view of an interactive water play structure according to an embodiment of the invention.

FIG. 1 illustrates an exemplary embodiment of a water play structure 100 for providing interactive entertainment to a plurality of play participants. In particular, the water play structure 100 comprises a plurality of water effects that can be activated, for example, by one or more play participants through participation with one or more play elements. In certain embodiments, play participants control and/or affect the movement of play media in order to achieve a particular play effect and/or water effect.

For instance, in certain embodiments, the water play structure 100 is configured such that play participants operate at least one interactive play element to complete one of multiple steps, which results in a transfer of kinetic energy at each step. In such embodiments, play participants can work together in a collective team effort to complete several smaller objectives, each comprising a step in a chain of triggering events. Once the individual steps are completed, the desired end result is brought about, such as for example, the release of a cannonball, the spilling of water from a giant tipping bucket, combinations of the same or the like. Alternatively, an end result or desired effect can include a spectacular domino-like cascade of various mechanisms, balls, water and/or the like, each resulting in a release or transfer of kinetic energy or other energy from one mechanism to another.

As shown, the water play structure 100 comprises a plurality of guide elements 102 that provide one or more paths through which play media travel. For example, in certain embodiments, the guide elements 102 are configured to accommodate spherical play media, such as a plurality of balls. As will be described in more detail hereinafter, the water play structure 100 is preferably arranged to permit play participants to interact, either directly or indirectly, with the play media to direct the play media to one or more destinations and/or to produce one or more effects, such as water effects. For instance, in certain embodiments, one or more of the guide elements 102 can be configured to permit participants to cause the play media to be selectively diverted along various paths of the guide element structure.

As shown in FIG. 1, the guide elements 102 are preferably oriented such that gravity assists the play media moving therethrough. In yet other embodiments, the guide elements 102 can comprise one or more mechanical devices or other systems usable to transport the play media through the guide elements 102. For instance, one or more of the guide elements 102 can comprise an auger, a conveyor, a pneumatic system (for example, a pump), a pressurized system, combinations of the same or the like.

In certain embodiments, suitable play media usable with the water play structure 100 can include, for example, water, tennis balls, foam balls, rubber balls, beach balls, balloon balls, bowling balls, FRISBEES™, foam darts or arrows, snow, mud, water balloons, slime, combinations of the same or other like play media capable of receiving or transferring kinetic energy. In an outdoor setting, durable plastic or rubber play media are particularly advantageous since environmental exposure may prematurely destroy or degrade the quality of certain play media such as foam balls.

In the illustrated embodiment, the guide elements 102 are tubular conduits. However, in other embodiments of the invention, the guide elements 102 can comprise other shapes or types of structures appropriately configured to accommodate the play media. For instance, the guide elements can comprise tracks (for example, free-floating tracks), pipes, ramps, tunnels, channels, combinations of the same or the like. In certain further embodiments, the interactive water play structure 100 can include a combination of two or more guide elements 102 that are differently shaped, sized or otherwise configured.

In certain embodiments, the guide elements 102 of the water play structure 100 are interconnected and/or originate from a common area or apparatus. In yet other embodiments, each of the guide elements 102 defines an independent path that does not intersect other of the guide elements 102.

In certain embodiments, the play media are advantageously positioned out of the reach of play participants, so as to increase safety and reduce disruptions. For example, the guide elements 102 that carry the play media can be sufficiently elevated from the ground. Alternatively, the interactive water play apparatus 100 can be configured such that some or all of the play media are accessible by the participants.

The illustrated interactive water play structure 100 further comprises a plurality of waterslides 110 extending from tower structures 112. The illustrated water play structure 100 also comprises a plurality of water effects, such as tipping water buckets 120. In certain embodiments, the buckets 120 are configured to discharge water directly on participants, onto other surfaces, into containers or channels or in any other suitable manner. Other water effects, certain of which are described in more detail below, can also be included in addition to, or in lieu of, the tipping water buckets 120. For instance, the interactive water play structure 100 can comprise one or more of the following water effects: water gun, water cannon, cannonball, shower, water jet, fountain, pinwheel sprinkler, weir, external and/or internal nipple nozzle, cone nozzle, a geyser nozzle, platform nozzle, fog nozzle, laminar flow nozzle, jumping water ball nozzle, curtain water fall weir, weir with inclined surface, rake water fall weir, open pipe aperture, pool and runnel aperture, bucket aperture, combinations of the same or the like.

As depicted in FIG. 1, the interactive water play structure 100 is advantageously incorporated into a larger amusement or water park setting, which in certain embodiments can optionally include other features. For instance, the setting of the interactive water play structure 100 includes walkways 150 (for example, between the towers 112) and gathering areas 152. In yet other embodiments, the setting can include retail shops, platforms, conduits, grates, bridges, tunnels, walls, pools, wheels, combinations of the same or the like that invite participants (wet or dry) to play and observers to enjoy hours of fun and fancy.

In yet other embodiments of the invention, the water play structure 100 can be implemented in accordance with a wide variety of other play themes using any combination of play media. For example, the water play structure 100 can be implemented as a factory floor assembly line, an island tree house, a lost temple, a fire station, a fort, a teepee, a factory, a vehicle (for example, rocket ship, automobile, submarine, or fireboat), an animal (for example, whale dinosaur, elephant or rhinoceros), a dungeon, a wizard's castle, combinations of the same or the like.

Figure 2:
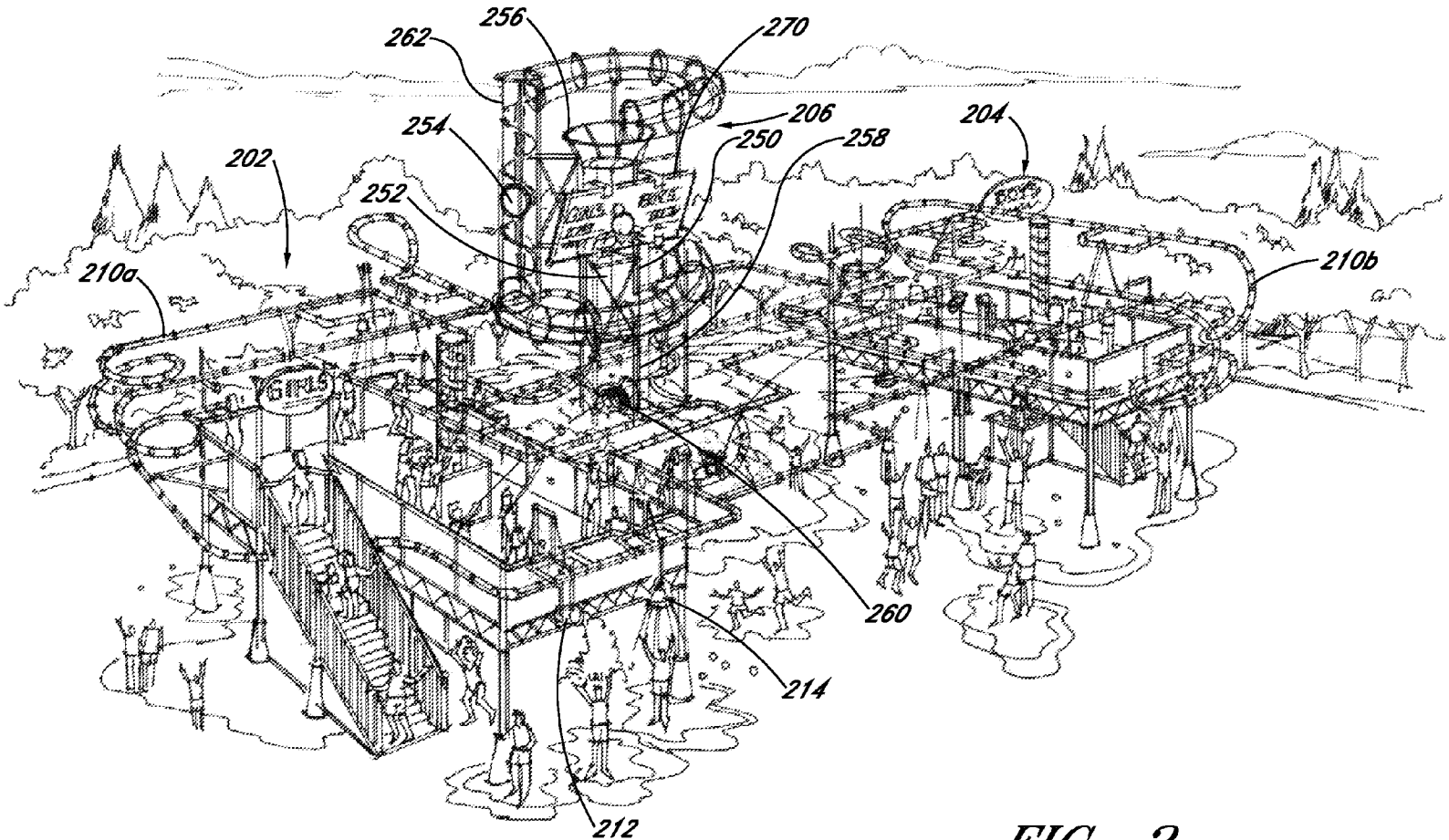
FIGS. 2-6 each illustrate a perspective view of an interactive water play structure having a cannonball apparatus according to certain embodiments of the invention.

FIG. 2 illustrates a water play structure 200 for providing interactive entertainment to a plurality of play participants, according to another embodiment of the invention. As can be seen, the illustrated water play structure 200 comprises similar elements and/or functions similarly as the water play structure 100 of FIG. 1. To simplify the description, however, components will not be redescribed in detail if like components are described above.

The illustrated water play structure 200 is arranged such that two groups of participants can compete against each other to, among other things, activate a main water effect. In particular, the water play structure 200 comprises a girls section 202, a boys section 204 and a cannonball water effect 206. In other embodiments, the water play structure 200 can be configured for other types of competition (for example, additional groups), can comprise additional sections, or the like.

In certain arrangements, each participant or group of participants attempts to negotiate play media (for example, balls) to one or more target destinations within the guide structure or other location(s) within the interactive water play structure 200. In certain embodiments, the winning participant or group can bring about one or more effects, such as the tipping of a water bucket, the release of a cannonball, and so forth. Alternatively, the prevailing party may win a prize or be awarded a certain number of points.

In certain embodiments, girl participants compete against boy participants to activate the cannonball water effect 206. For instance, the girl participants can interact with certain play elements of the girls section 202 of the water play structure 200, and the boy participants can interact with certain play elements of the boys section 204 of the water play structure 200.

As illustrated, the girls section 202 comprises a plurality of guide elements 210*a*, which can be similar in structure and/or function to the guide elements 102 of the water play structure 100. Likewise, the boys section 204 comprises a plurality of guide elements 210*b*. The water play structure 200 further includes several water play effects, such as tipping buckets 212, showers 214, water cannons and the like.

The water play structure 200 further comprises the cannonball water effect 206. In certain embodiments, the play participants compete and/or work together to activate the cannonball water effect 206, which can, for example, cause a wave of water to be displaced from a pool or other body of water. In particular, the illustrated cannonball water effect 206 comprises a tower 250 having walls that define a vertical path 252 along which a projectile 254 (such as, for example, a ball), descends. The tower 250 further includes a top portion 256, which is configured to selectively release the projectile 254 to fall down the vertical path 252 to a bottom portion 258 of the tower 250. In certain embodiments, the bottom portion 258 of the tower 250 includes, or is near, a pool 260 of water.

The cannonball water effect 206 also includes a return conduit 262 configured to return the projectile 254 from the bottom portion 258 to the top portion 256 after the descent of the projectile 254. For instance, the return conduit 262 can comprise a closed, tube-like structure sized to transport and contain the projectile 254. In certain embodiments, the return conduit 262 advantageously includes an auger configured to transport the projectile 254 through the return conduit 262. In yet other embodiments, the return conduit 262 can comprise a conveyor, pneumatic pump, combinations of the same or like means for transporting the projectile 254.

Although the cannonball water effect 206 has been described with reference to particular examples, other embodiments of the invention can comprise alternative variations. For example, instead of creating an actual wave of water, the projectile 254 can cause a computer-generated wave to appear on a display at or near the vertical tower 250 or at the girls section 202 and/or the boys section 204. In yet further embodiments, the projectile 254 can also be computer generated.

As discussed in more detail hereinafter, in certain embodiments, the projectile 254 is advantageously sized to cause one or more waves of water when falling into the pool 260. In certain embodiments, one or more pumps or other means can be used to assist in projecting and/or displacing water from the pool 260 when the projectile 254 arrives at the bottom portion 258 of the vertical tower 250. In such embodiments, the projectile 254 may or may not directly contact the water. For instance, the projectile 254 can be wholly contained within a conduit such that the projectile 254 is isolated from the pool 260.

With continued reference to FIG. 2, the illustrated water play structure 200 further includes a display 270 associated with the tower 250. In certain embodiments, the display 270 can include a count-down timer that indicates how much time is left until the next cannonball is released or activated. In yet other embodiments, the display 270 can provide other information, such as, for example, a point total for one or more groups, the name(s) of one or more participants or groups, advertising, combinations of the same or the like.

Figure 3:
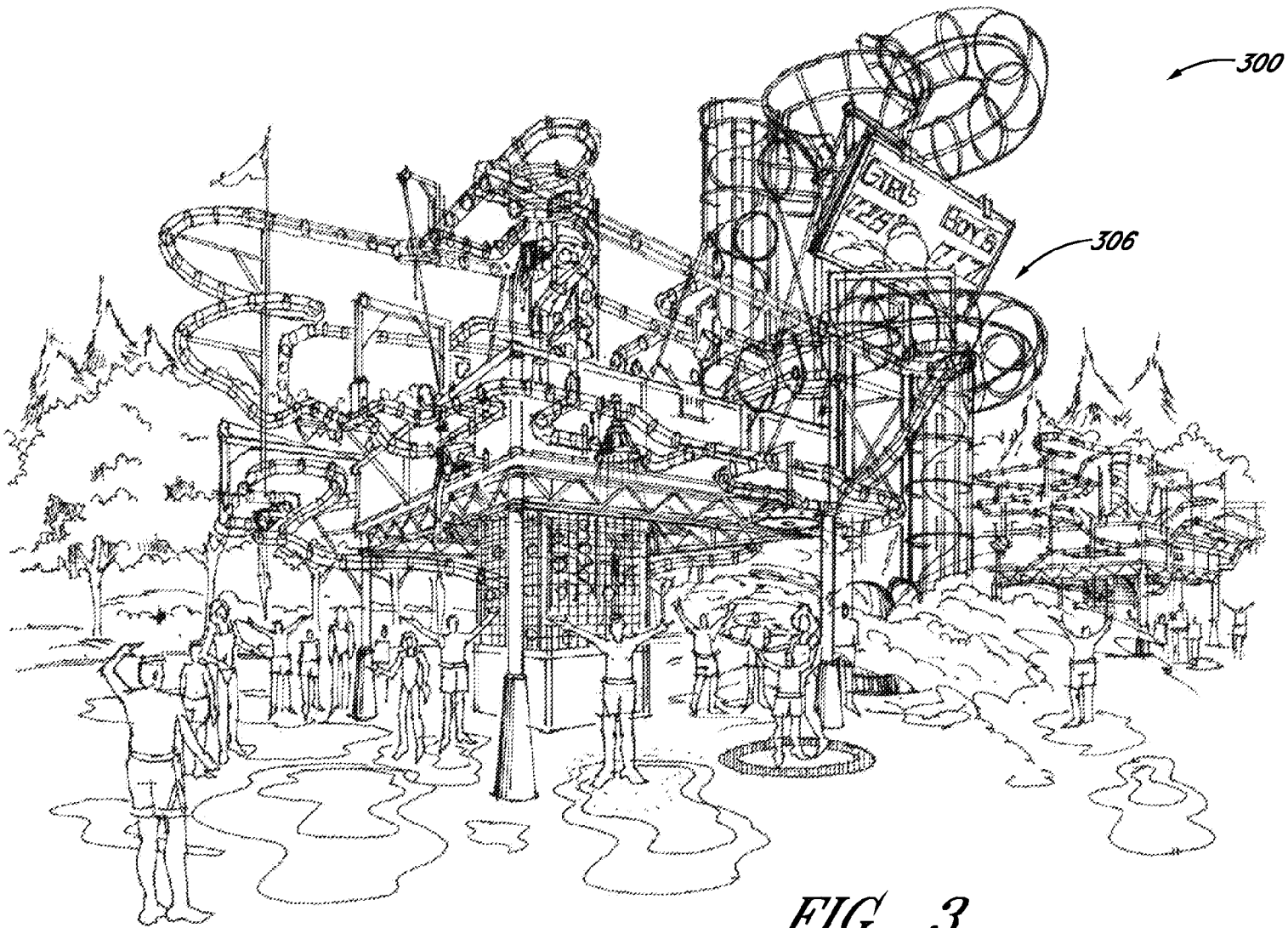

FIG. 3 illustrates a water play structure 300 for providing interactive entertainment to a plurality of play participants, according to another embodiment of the invention. As can be seen, the illustrated water play structure 300 comprises similar elements and/or functions similarly as the water play structure 200 of FIG. 2. For instance, the illustrated water play structure 300 is arranged for a plurality of groups to participate and/or compete to activate a cannonball water effect 306.

Figure 4:
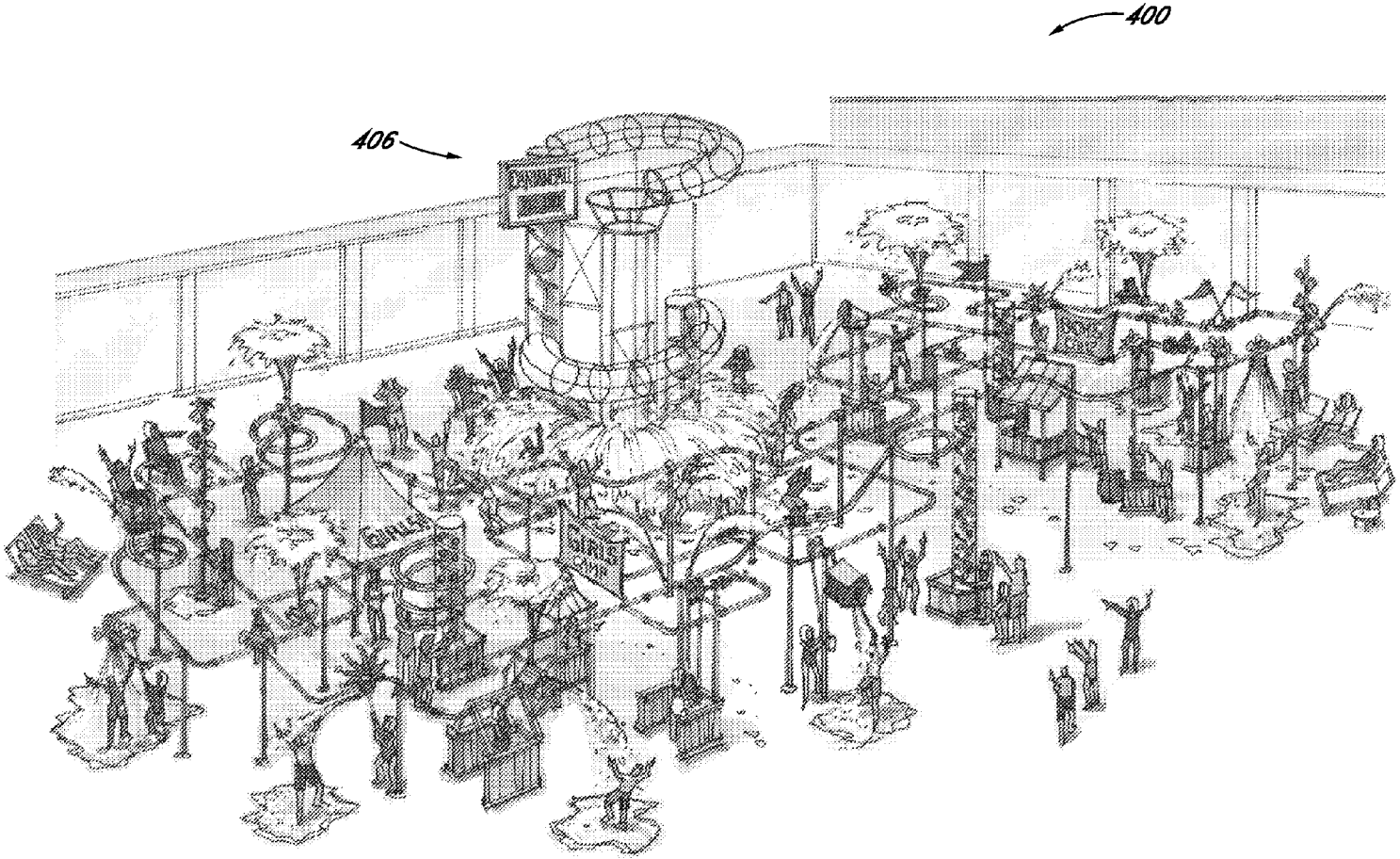

FIG. 4 illustrates a water play structure 400 for providing interactive entertainment to a plurality of play participants, according to another embodiment of the invention. As can be seen, the illustrated water play structure 400 comprises similar elements and/or functions similarly as the water play structures 200 and 300 of FIGS. 2 and 3. For instance, the illustrated water play structure 400 is arranged for a plurality of groups to participate and/or compete to activate a cannonball water effect 406. Moreover, the water play structure 400 is implemented on a single level.

Figure 5:
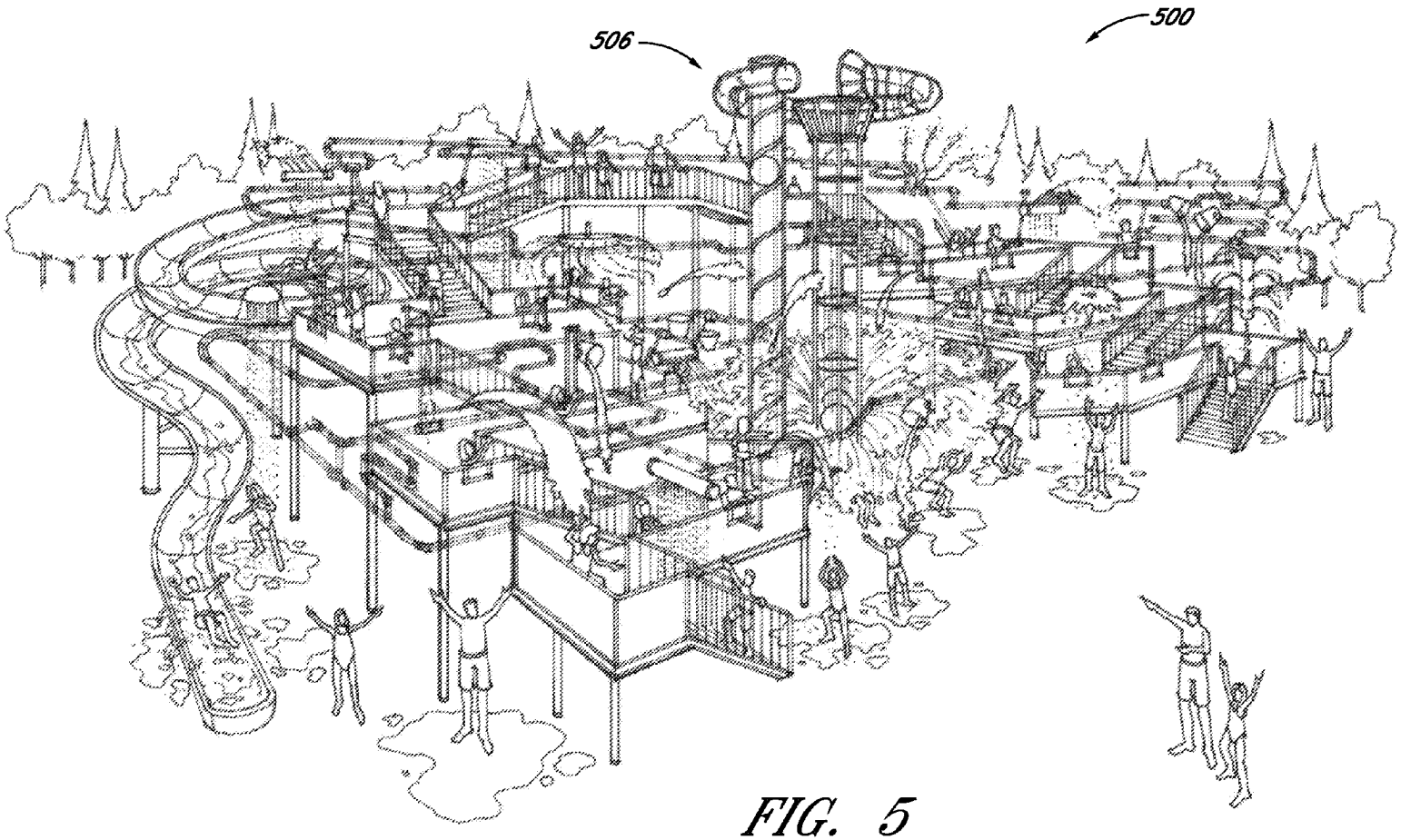

FIG. 5 illustrates a water play structure 500 for providing interactive entertainment to a plurality of play participants, according to another embodiment of the invention. As can be seen, the illustrated water play structure 500 comprises similar elements and/or functions similarly as the water play structures of FIGS. 2-4. For instance, the illustrated water play structure 500 is arranged for a plurality of groups to participate and/or compete to activate a cannonball water effect 506.

Figure 6:
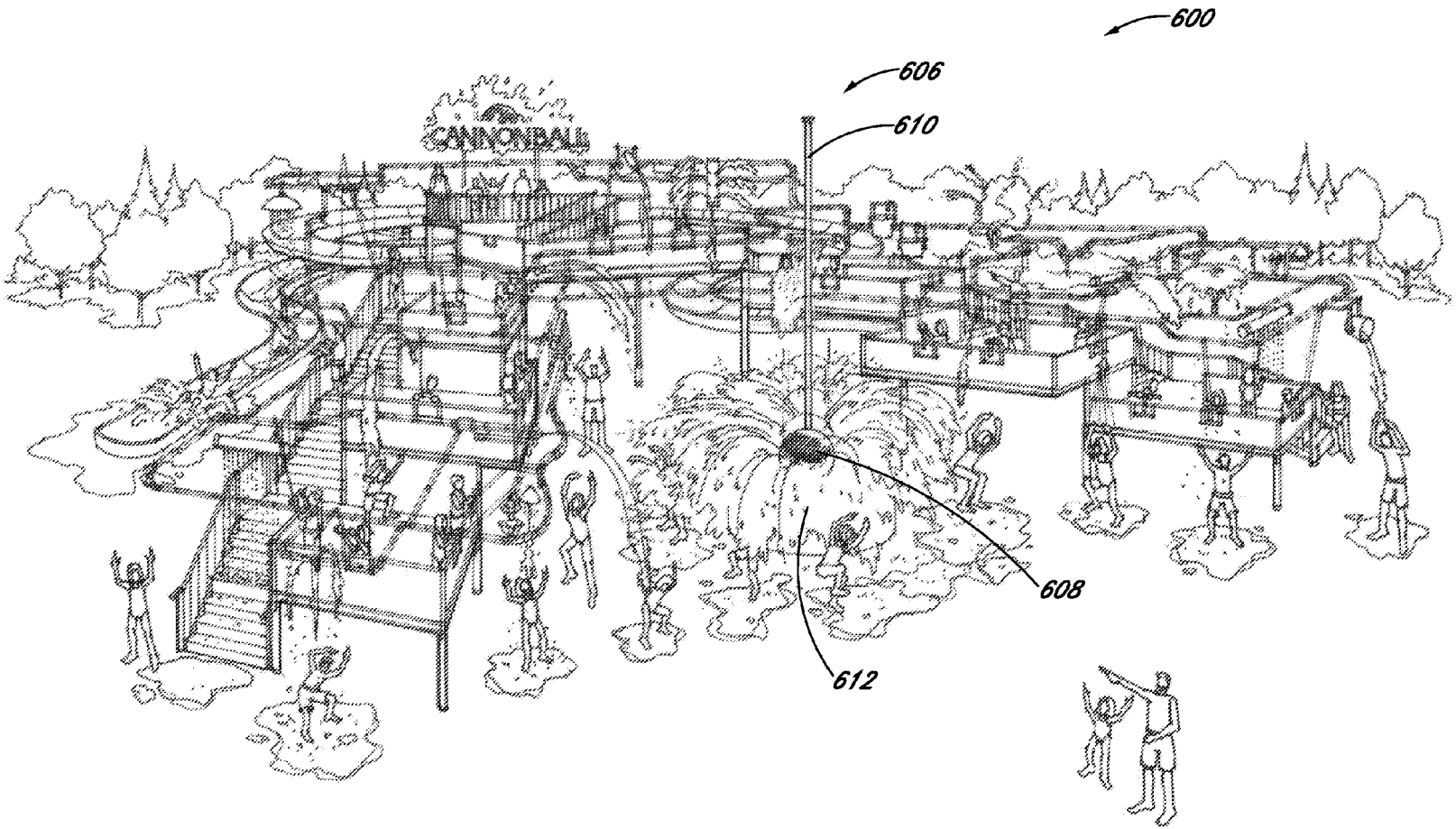

FIG. 6 illustrates a water play structure 600 for providing interactive entertainment to a plurality of play participants, according to another embodiment of the invention. As can be seen, the illustrated water play structure 600 comprises similar elements and/or functions similarly as the water play structures of FIGS. 2-5.

For instance, the illustrated water play structure 600 is arranged for a plurality of groups to participate and/or compete to activate a cannonball water effect 606. In particular, the illustrated cannonball water effect 606 comprises a cannonball 608 movably attached to a vertical member 610, such as a pole. For instance, the vertical member 610 can extend through the cannonball 608 such that the cannonball 608 slides down the vertical member 610. In other embodiments, the vertical member 610 can be attached to a periphery of the cannonball 608.

In certain embodiments, the vertical member 610 further includes mechanics for triggering the release of the cannonball 608 down the vertical member 610 and/or for elevating the cannonball 608 after a fall. When the cannonball water effect 606 is activated, the cannonball 608 descends down the vertical member 610 and causes water to be radially displaced from a pool 612.

Figure 7A:
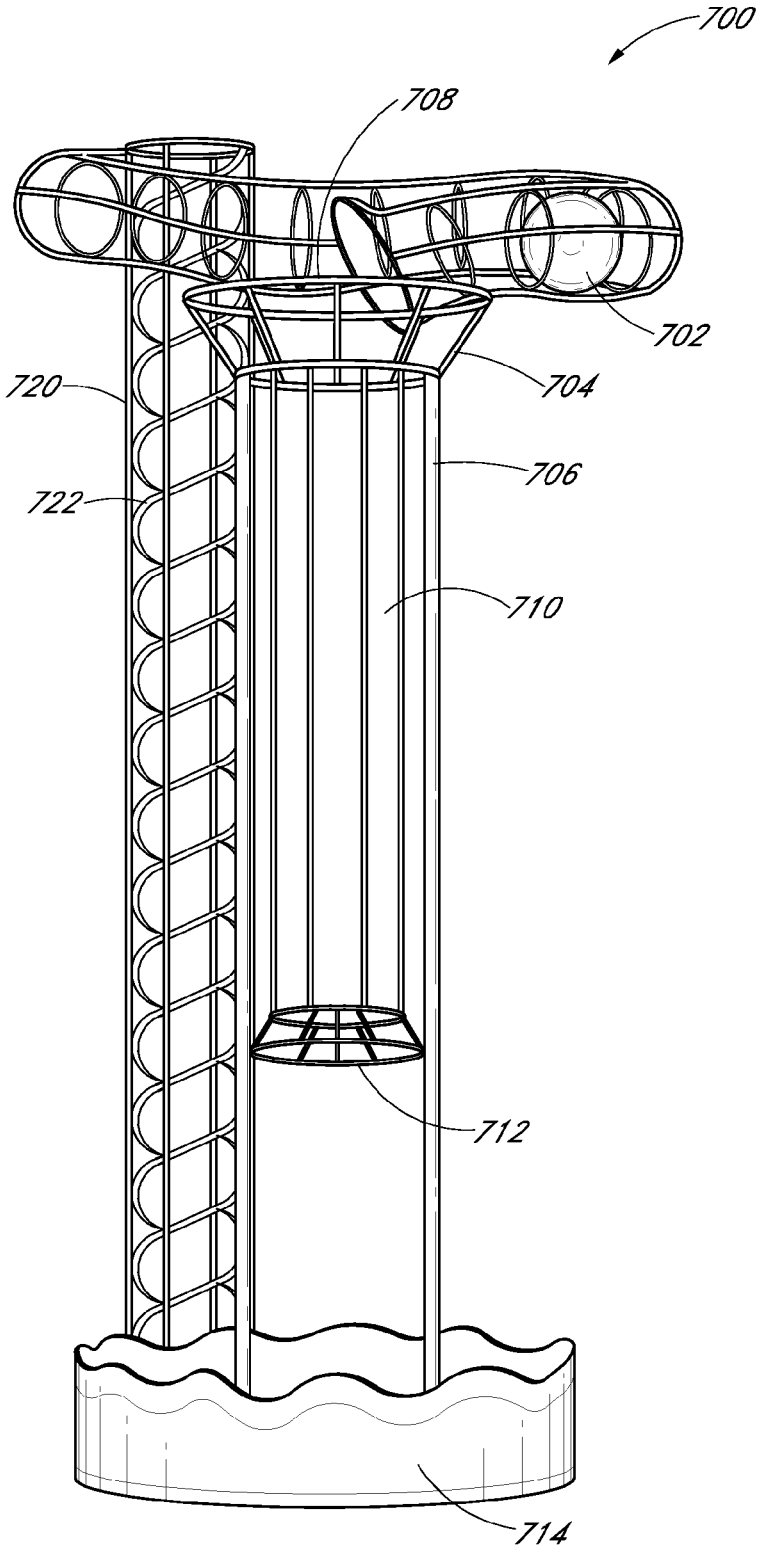
FIGS. 7A-7C illustrate a cannonball apparatus usable with the water play structures of FIGS. 1-5, according to certain embodiments of the invention. In particular, each of FIGS. 7A-7C illustrates a different stage of a cannonball apparatus during activation of a water effect.
Figure 7B:
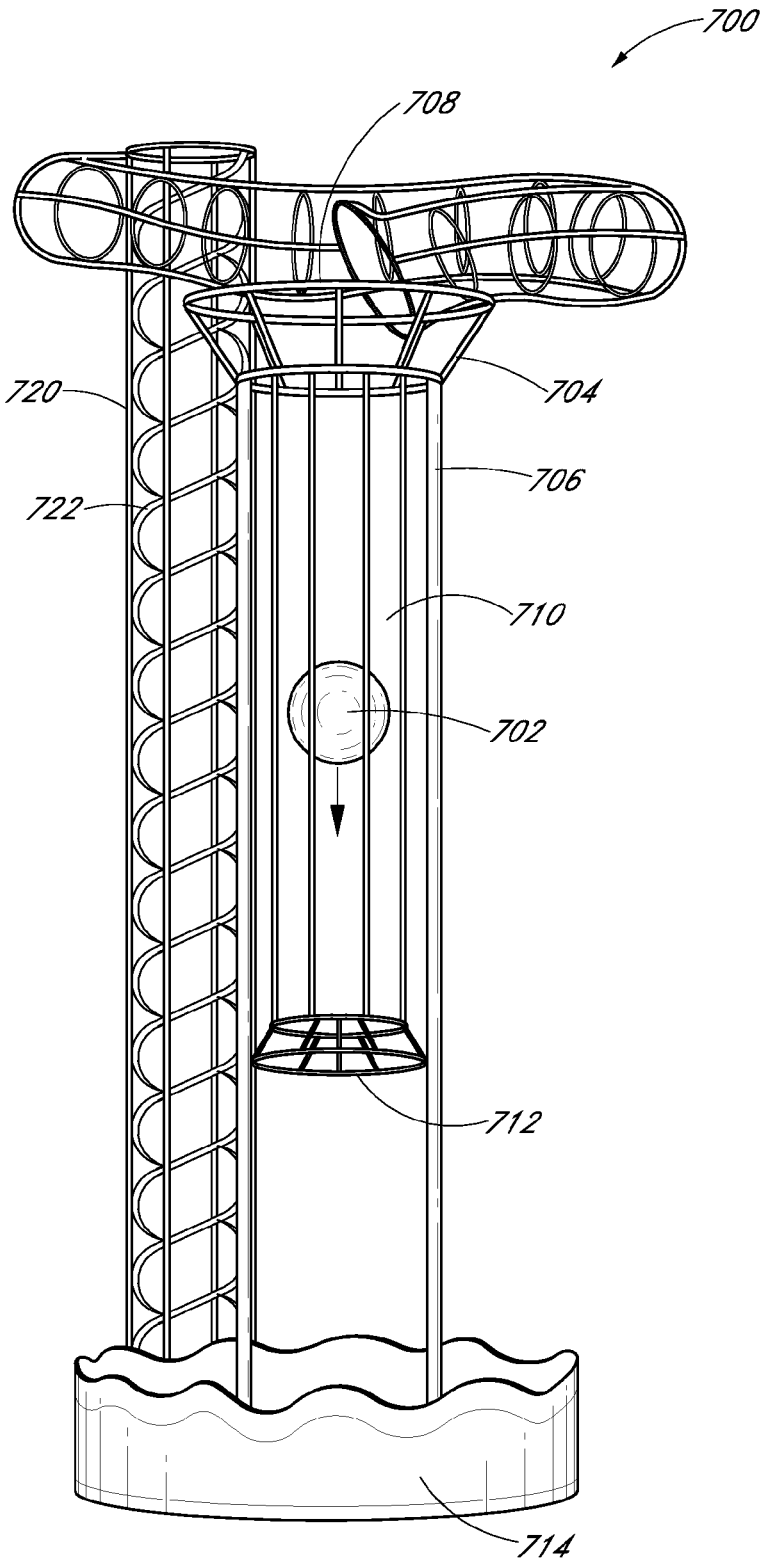
Figure 7C:
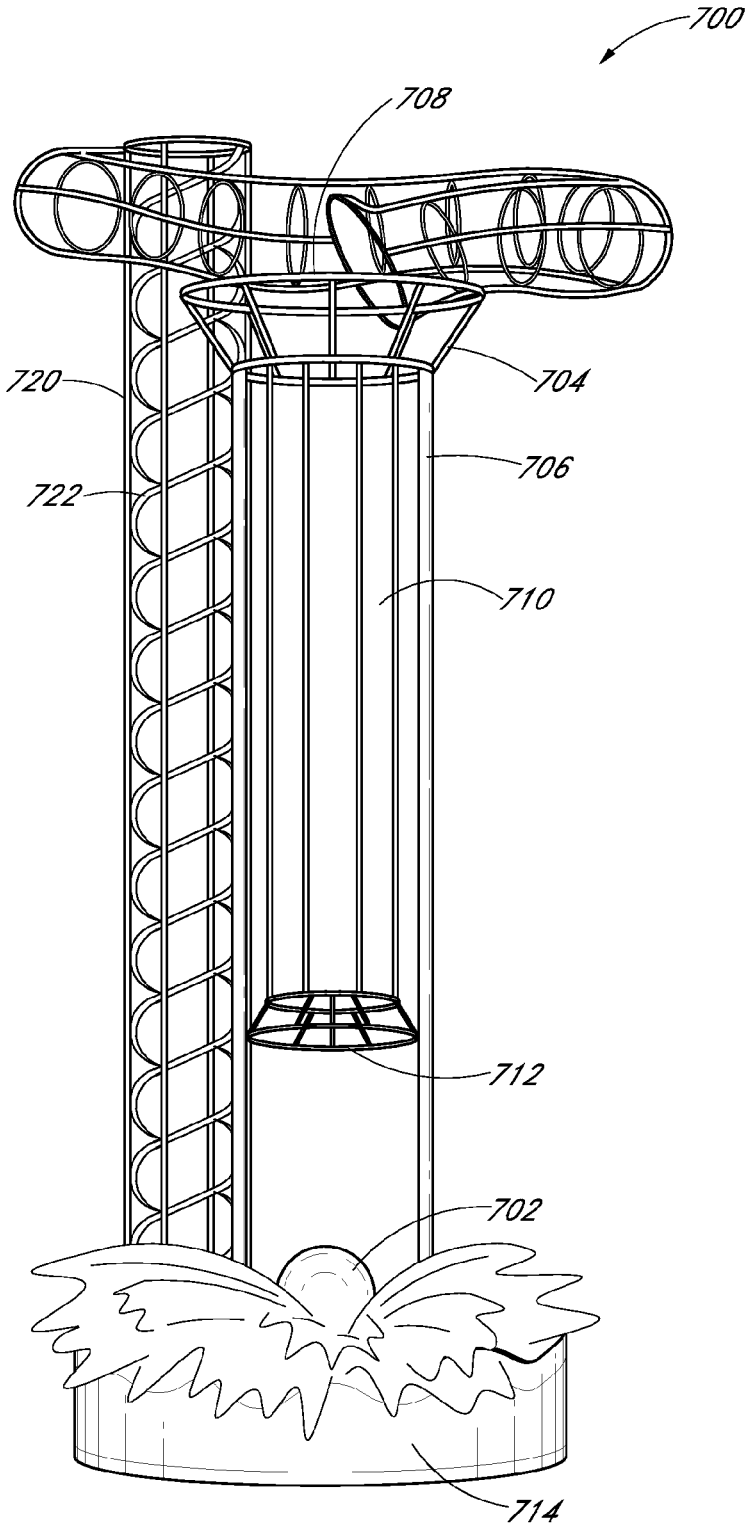

FIGS. 7A-7C illustrate an exemplary embodiment of a cannonball apparatus 700. In particular, each of FIGS. 7A-7C illustrates a different stage of a cannonball apparatus 700 during activation of a water effect. FIG. 7A illustrates a perspective view of the cannonball apparatus 700 during a pre-fall stage, FIG. 7B illustrates a perspective view of the cannonball apparatus 700 during a fall stage, and FIG. 7C illustrates a perspective view of the cannonball apparatus 700 in a final or splash stage.

In certain embodiments, the cannonball apparatus 700 functions as a stand-alone attraction. In yet other embodiments, the cannonball apparatus 700 is usable with water play structures, such as those shown and described with reference to FIGS. 2-5.

In general, the cannonball apparatus 700 is configured to provide for water play as a cannonball 702 is dropped into a pool of water. In certain embodiments, the "release" of the cannonball 702 occurs periodically based on predetermined intervals. In yet other embodiments, the cannonball 702 can be released at random times so as to add more excitement and unpredictability to the water play. In yet other embodiments, the release of the cannonball 702 is triggered by the completion of at least one task by one or more play participants. For example, in a competition between multiple groups, the winning group may cause the release of the cannonball 702.

As illustrated, the cannonball apparatus 700 includes a chute portion 704 associated with a vertical support structure 706. The chute portion 704 is configured to receive the cannonball 702 at a top end 708. To facilitate reception of the cannonball 702, the top end 708 can be advantageously funnel-shaped or the like. The chute portion 704 further includes an elongated body 710 through which the cannonball 702 travels while descending (see FIG. 7B) toward a pool of water. The chute portion 704 further includes a bottom end 712.

In certain embodiments, the chute portion 704 and/or vertical support structure 706 can be transparent and/or translucent such that play participants can watch the descent of the cannonball 702. In other embodiments, the chute portion 704 and/or the vertical support structure 706 can comprise portions that are transparent/translucent and other portions that are opaque.

Although the chute portion 704 and vertical support structure 706 are described as separate components, it is also contemplated that the chute portion 704 and vertical support structure 706 can be integrated into a single structure or apparatus. For instance, the vertical support structure 706 can comprise a funnel portion for receiving the cannonball 702.

In certain embodiments, the chute portion 704 and/or vertical support structure 706 advantageously define a descent path for the cannonball 702. In certain embodiments, the descent path comprises a length of between approximately 30 feet and approximately 60 feet and, more particularly, between approximately 40 feet and approximately 50 feet. In yet other embodiments, the descent path may be longer than approximately 60 feet or shorter than approximately 30 feet depending on one or more design factors of the cannonball apparatus 700 (for example, the size and/or weight of the cannonball 702, the size and/or depth of the container 714, combinations of the same or the like). In addition, in some embodiments, the support structure 706 may be implemented at an angle.

The illustrated cannonball apparatus 700 further includes a container 714 that is at least partially filed with water. As shown in FIG. 7C, as the cannonball 702 exits the chute portion 704, the cannonball 702 falls into the water and causes the water to be radially displaced from the container 714, such as onto nearby play participants. In certain embodiments, after the displacement of the water, the container 714 is refilled for the next cannonball drop.

In certain embodiments, the container 714 comprises a substantially circular splash pool having a diameter of approximately eight feet and a depth of four feet. In certain embodiments, at least a portion of the container 714 is below the ground and/or a surrounding deck, which preferably comprises a non-slip surface. For instance, the container 714 can be positioned at least two feet below ground level. In yet other embodiments, other measurements or configurations may be used for the container 714 to achieve the desired effects.

Moreover, it certain embodiments, the sides of the container 714 are sufficiently high to prevent individuals from entering the pool of water held therein. In yet other embodiments, a gate or other like means can be positioned around the cannonball apparatus 700 for safety purposes.

The cannonball apparatus 700 further includes a return conduit 720 for transporting the cannonball 702 from the container 714 to the chute portion 704. As shown, the return conduit 720 includes an auger 722 for transporting the cannonball 702 through the return conduit 720. In particular, rotation of the auger 722 elevates the cannonball 702 through vertically-oriented portions of the return conduit 720 (for example, portions of the return conduit 720 wherein travel therethrough is against the force of gravity). In portions of the return conduit 720 that are not oriented against the force of gravity, the path of the return conduit 720 can be substantially clear such that the cannonball 702 can more easily roll therethrough.

In certain embodiments, the return conduit 720 and/or the chute portion 704 further includes a trigger mechanism for temporarily stopping movement of the cannonball 702. For instance, a lever, gate, switch or other like means can be used for timing the "release" of the cannonball 702 down the cannonball apparatus 700. Such a mechanism can be advantageously placed within the return conduit 720 near or at the top end 708 of the chute portion 704. In yet other embodiments, the trigger mechanism can be placed within the chute portion 704 and/or the vertical support structure 706. In yet other embodiments, the auger 722 can stop rotation so as to temporarily halt movement of the cannonball 702 until an appropriate release time.

In certain embodiments, the cannonball object 702 is a substantially spherical object with a diameter of between approximately three feet and approximately six feet and, more particularly, between approximately four feet and approximately five feet. In other embodiments, the cannonball object 702 can have a diameter of less than approximately three feet or more than approximately six feet.

In certain embodiments, the cannonball object 702 has a weight of at least approximately 500 pounds and, more particularly, at least approximately 750 pounds. For instance, the cannonball 702 can comprise an outer shell constructed of metal, steel, plastic, combinations of the same or other like durable material. The cannonball 702 can also comprise a solid construction or be sand-filled, liquid-filled (for example, water-filled), or the like. In certain embodiments, the cannonball 702 has a weight, shape, and/or size sufficient to displace a desired amount of water from the container 714. Thus, embodiments of the cannonball 702 can take on a variety of weights, shapes, and/or sizes depending on the other design specifications of the cannonball apparatus 700. For instance, in embodiments of the invention wherein the cannonball 702 does not directly contact the water and/or the water effect is at least partially simulated, the cannonball 702 can have a weight of substantially less than 500 pounds.

Although the cannonball apparatus 700 has been described with reference to particular embodiments, alternative embodiments can also be used. For example, the cannonball 702 can take on a different shape and/or design. For instance, in other embodiments of the invention, the cannonball apparatus 700 can utilize a more decoratively designed ball, such as a ball similar to the one used at New York Times Square during the New Years celebration. In other arrangements, the cannonball apparatus 700 can use a non-spherical object in place of the cannonball 702, such as, for example, a large bug, a figurine, or the like.

In certain embodiments, the water effect generated by the cannonball apparatus 700 can be achieved through a variety of methods. For instance, the cannonball 702 can store water within the cannonball. In other embodiments, a simulated splash can be generated when the cannonball 702 reaches the container 714. For instance, the simulated splash can be depicted on one or more displays. In other embodiments, additional hydraulic, mechanical, electrical and other like methods of creating the simulated and/or actual splash can be used.

In other embodiments, the container 714 can be altogether removed from the cannonball apparatus 700. For example, the cannonball 702, or other like object, can be configured to enter a hole in the ground. In other embodiments of the invention, the height from which the cannonball 702 begins its descent can be varied between drops (for example, randomly, at the discretion of one or more participants, and so forth). In addition, the cannonball apparatus 700 can be configured to direct the cannonball 702 in a variety of paths including, but not limited to, vertical, angled, curved, helical, as well as a combination of two or more types of paths.

Figure 8:
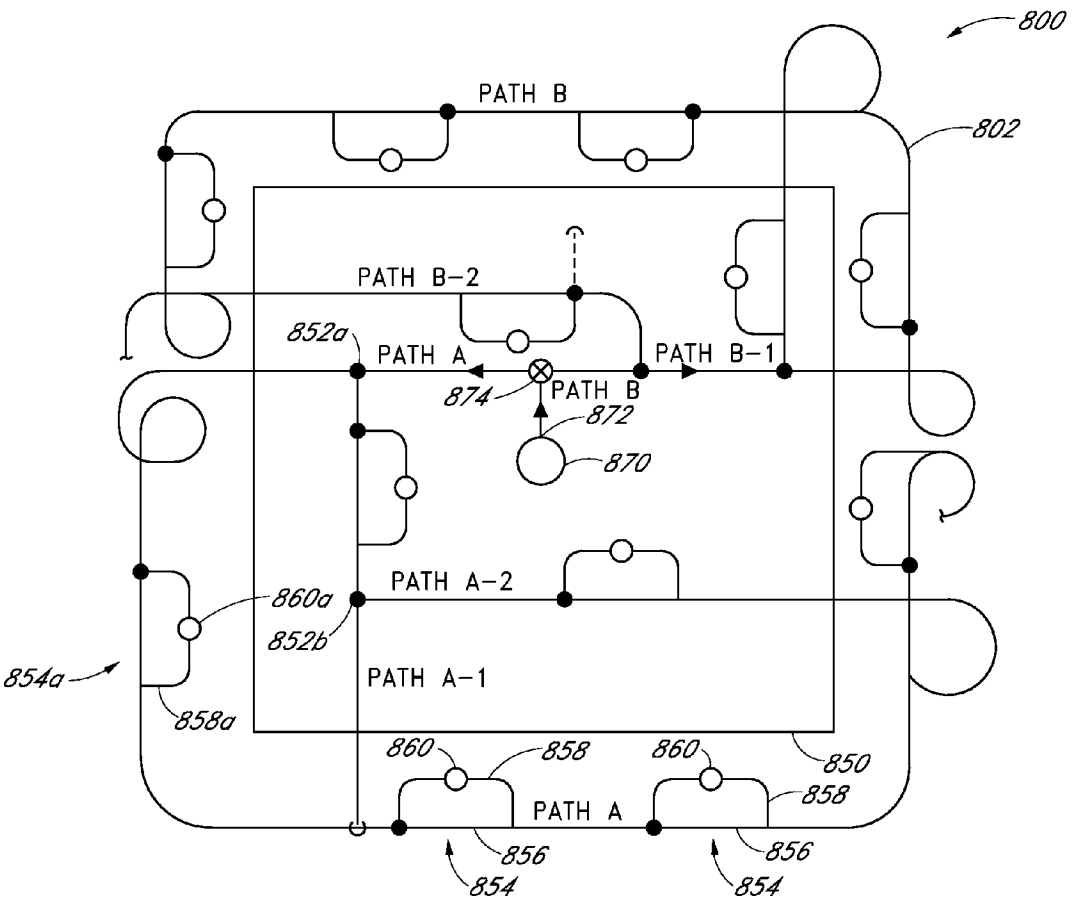
FIG. 8 illustrates a top schematic view of an interactive water play structure according to an embodiment of the invention.

FIG. 8 illustrates a schematic diagram of a water play structure 800 according to an embodiment of the invention. In particular, the water play structure 800 includes various paths and/or routes that play media can take while traveling along one or more guide elements, such as described with reference to FIGS. 1-6. For exemplary purposes and ease of description, the water play structure 800 will be described with reference to play media in the form of a single ball. It will be understood, however, that the water play structure 800 can be configured to accommodate one or more play media in the shape of balls or other shapes as disclosed herein.

The schematic diagram of FIG. 8 illustrates a top perspective of the water play structure 800, which includes a guide element 802 and a platform 850. In certain embodiments, the guide element 802 is similar to any of the guide elements disclosed in more detail above. The platform 850, in certain embodiments, comprises a square-like platform having a side of between approximately ten feet and approximately twenty feet long. For instance, in certain embodiments, the platform 850 has a side of approximately twelve feet long. In certain embodiments, the platform 850 is advantageously elevated off the ground and facilitates interaction between play participants and one or more interactive sections of the water play structure 800.

The interactive sections of the illustrated water play structure 800 include switch points 852 and interactive modules 854. As shown, the switch points 852 are configured to allow a play participant to alter the travel path of the ball on the guide element 802. For instance, in certain embodiments, the switch points 852 include a rope lever, a button, a sensor (for example, a magnetic sensor, an optical sensor, a radio frequency identification device (RFID) reader, combinations of the same or the like) that a play participant can activate, actuate and/or trigger to divert the travel path of the ball from one portion of the guide element 802 to another portion. In certain embodiments, the play participant can directly control and/or indirectly control the travel path of the ball.

The interactive modules 854, in an active state, are configured to temporarily divert the ball from a default path 856 along the guide element 802 to a secondary path 858. For instance, the interactive module 854 can comprise a rope lever, a button, a sensor (for example, a magnetic sensor, an optical sensor, an RFID reader, combinations of the same or the like) that a play participant can activate, actuate and/or trigger to divert the travel path of the ball from the default path 856 to the secondary path 858.

In certain embodiments, the interactive module 854 further includes a water effect 860 that is activated when the ball travels along the secondary path 858, as described in more detail below with respect to FIGS. 9A and 9B. In certain embodiments, the play participant can independently activate the water effect 860.

An example of how the water play structure 800 can function will now be described with reference to FIG. 8. Initially, the ball is transported through a conduit 870 to a starting point 872 of the guide element 802. In certain embodiments, the starting point 872 is located at or near the most elevated portion of the guide element 802 such that the force of gravity is used to guide the ball down the guide element 802. In certain embodiments, the ball is transported through the conduit 870 by an auger or like mechanism.

The ball begins traveling along the guide element 802 to an initial switching point 874. In general, the initial switching point 874 selects between multiple paths of the guide element 802. In the depicted embodiment, the initial switching point 874 comprises an automatic switch that directs each ball alternatively to Path A or to Path B of the guide element 802. In yet other embodiments, the initial switching point 874 can comprise a random switch or a device that is controlled by one or more play participants. In yet other embodiments, the initial switching point 874 alternates between more than two paths, or the water play structure 800 can perform without the initial switching point 874.

Traveling along the Path A route, the ball comes to a switch point 852*a*. In certain embodiments, if the switch point 852*a* is not activated, the ball continues to travel along Path A. If the switch point 852*a* is activated, the ball is diverted to Path A-1.

If the ball continues along the Path A route, the ball then encounters an interactive module 854*a*. If the interactive module 854*a* is not in an active state, the ball continues along the default Path A. On the other hand, if the interactive module 854*a* is in an active state, the ball is diverted to a secondary path 858*a*. In certain embodiments, the ball activates a water effect 860*a* while traveling along the secondary path 858*a*. As shown, after traveling along the secondary path 858*a*, the ball returns to the Path A.

FIG. 8 depicts several other switch points and interactive modules along the guide element 802 that can function similarly to the switch point 852*a* and/or the interactive module 854*a* described above. For instance, the switch point 852*b* is configured to direct the travel path of the ball from Path A-1 to Path A-2.

As is also shown by FIG. 8, Paths A-1 and A-2 ultimately terminate at Path A. Such a configuration advantageously allows for a common destination for play media traveling along the guide element 802. In yet other embodiments, either or both of Paths A-1 and A-2 can terminate at a different destination, can join together, and/or can feed into other guide elements.

In certain embodiments, Path B functions similarly to Path A and also includes switch points 852 and interactive modules 854. As shown, the water play structure 800 also includes alternative routes, Path B-1 and Path B-2.

In certain embodiments, if none of the switch points 852 or interactive modules 854 are activated at the time the ball passes therethrough, the ball continues along a default path (for example, either Path A or Path B).

It will be appreciated that FIG. 8 illustrates a non-limiting arrangement of the interactive water play structure 800. In other embodiments, the interactive water play structure 800 can be of a more complex (for example, having additional alternative pathways) or of a simpler arrangement.

Figure 9A:
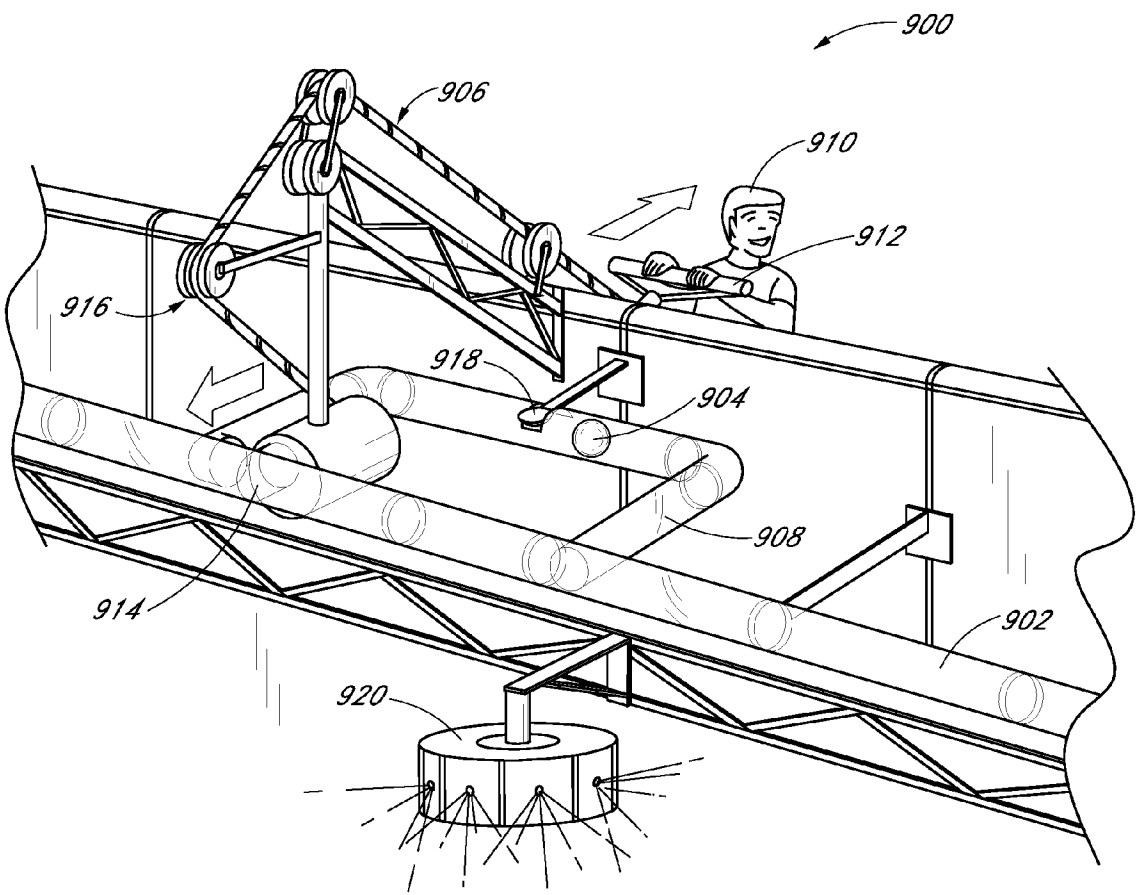
FIG. 9A illustrates a perspective view of an interactive module usable with the water play structures of FIGS. 1-6, and 8 according to certain embodiments of the invention.

FIGS. 9A and B illustrate further details of interactive modules usable with embodiments of the invention, such as with the water play structures disclosed herein. For instance, FIG. 9A illustrates an interactive module 900 for providing entertainment and/or challenges to one or more play participants, according to an embodiment of the invention. In particular, the interactive module 900 allows a play participant to alter the travel path of play media and/or activate a water effect through a hands-on play experience.

As shown, the interactive module 900 includes a default path 902 through which play media, such as a ball 904, can travel. The interactive module 900 further includes a diversion mechanism 906 that operates to switch the travel path of the ball 904 from the default path 902 to a secondary path 908.

In the depicted embodiment, a play participant 910 maneuvers a lever 912 to activate the diversion mechanism 906 and, therefore, divert the ball 904 from the default path 902 to the secondary path 908. As illustrated, maneuvering of the lever 912 causes a corresponding movement of a blocking member 914 to obstruct the default path 902 and prevent the ball 904 from continuing therethrough. In particular, the diversion mechanism 906 comprises a pulley system 916 that operatively couples the lever 912 to the blocking member 914.

In certain embodiments, the diversion mechanism 906 can be advantageously biased, such as through the use of a spring device, such that the blocking member 914 does not obstruct the default path 902 unless the play participant 910 maneuvers the lever 912. In yet other embodiments, once moved, the blocking member 914 can remain obstructing the default path 902 until the play participant 910 re-maneuvers the lever 912.

In certain embodiments, as the ball 904 passes through the secondary path 908, the ball 904 contacts and/or otherwise triggers an activation member 918, which, in turn, activates one or more water effects 920, such as a pinwheel sprinkler. In certain embodiments, the activation member 918 comprises a lever or other mechanical device configured to be triggered by the ball 904. In yet other embodiments, the activation member 918 can comprise one or more sensors that determine when the ball 904 is traveling through the secondary path 908. Such sensors can include, for example, motion sensors, weight sensors, light sensors, magnetic sensors, RFID readers, barcode readers, combinations of the same or the like.

As shown in FIG. 9A, each of the default path 902 and the secondary path 908 comprises a tubular structure. Such a structure advantageously prevents a play participant from manually touching and/or disturbing the ball 904. In other embodiments, either or both of the paths 902, 908 can comprise other forms and/or shapes, such as, for example, an open or exposed conduit, a track, an elongated trough or the like, suitable to transport corresponding play media.

In yet other embodiments, the diversion mechanism 906 can include other configurations that are capable of altering the path of the play media from the default path 902 to the secondary path 908. For instance, in other embodiments, the diversion mechanism 906 can be controlled by pulling a rope, actuating a button, triggering a magnetic mechanism, waving a radio frequency enabled "magic" wand or the like.

Figure 9B:
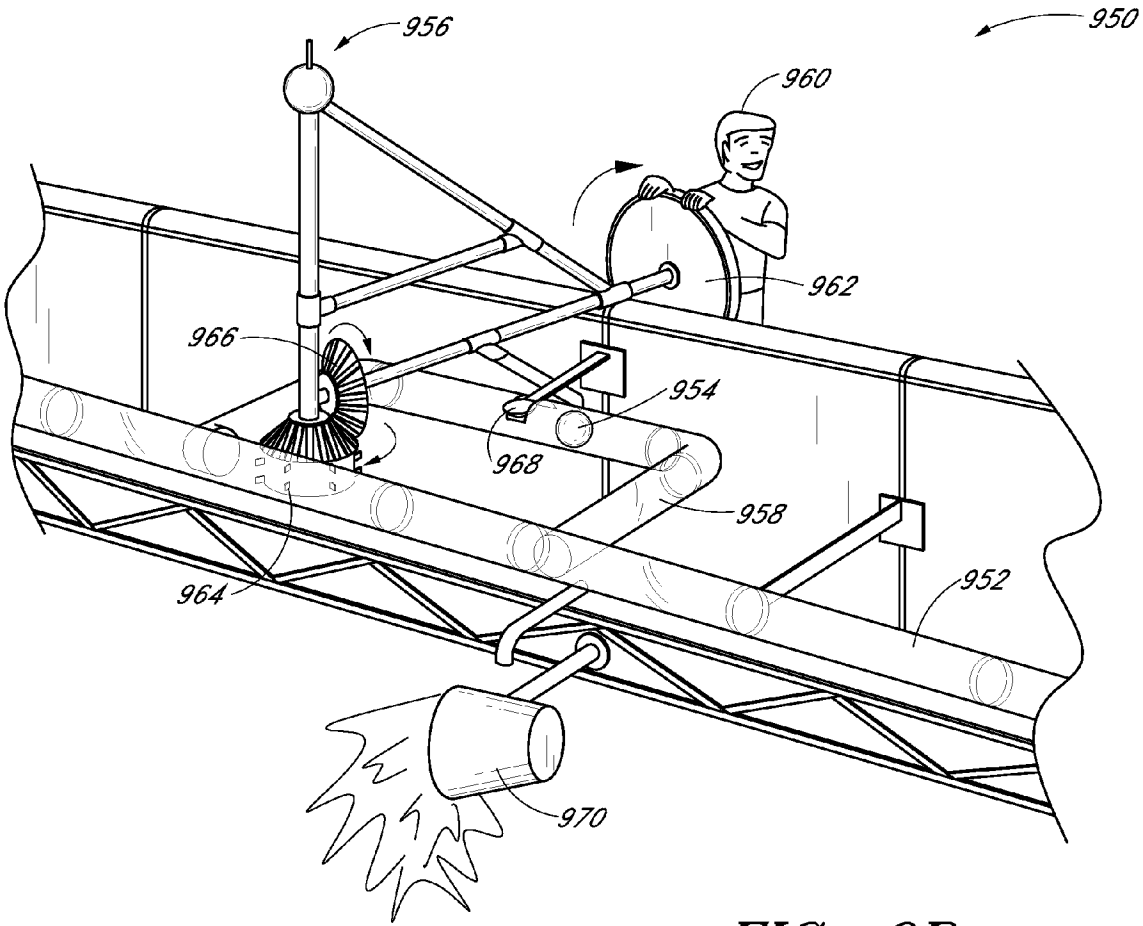
FIG. 9B illustrates a perspective view of another interactive module usable with the water play structures of FIGS. 1-6, and 8 according to certain embodiments of the invention.

FIG. 9B illustrates an interactive module 950 having another diversion mechanism 956 useable with embodiments of the water play structures described herein. In particular, the illustrated diversion mechanism 956 includes a handwheel 962 that a play participant 960 maneuvers to turn a series of gears 966. Turning of the gears 966 causes rotation of a shaft having multiple blocking tabs 964 so as to selectively position at least one of the blocking tabs 964 in a default path 952. With the default path 952 is obstructed, a ball 954 (or other play media) is redirected through a secondary path 958, thereby triggering an activation member 968.

The activation member 968 can comprise any of the devices described with reference to the activation member 918 of FIG. 9A. Furthermore, the activation member 968 is configured to activate one or more water effects 970, such as the dumping of a water bucket.

In some embodiments, the water play structure 100, 200, 300, 400, 500, 600 and/or the interactive module 900 may include one or more virtual components. For example, one or more of the guide elements may be virtual guide elements shown in a display device. As another example, the vertical structure 710 and/or the cannonball 702 may be implemented as a computer-simulated vertical structure and/or virtual cannonball 702. As a further example, one or more of the diversion mechanisms 906 may be a computer-simulated mechanism.

In addition to the foregoing, the interactive water play structures described herein can optionally include, or be associated with, a retail section. In the retail section, play participants can purchase, design, rent, borrow, and/or set in motion their own play media. For instance, certain balls can be uniquely labeled so as to identify a particular play participant or group. In other embodiments, the play media can include an RFID tag or other identification device that allows the ball to be electronically tracked and/or associated with a particular play participant or group of play participants.

Suitable play elements for use in embodiments of the inventions disclosed herein can include a diverse variety of both "wet" and "dry" mechanisms and devices, such as a pump, ball elevator, spiraling ball chute, pin wheel ball drop, water conveyer, gear system, ramp, pulley, conveyer, balance beam, water wheel, windmill and any other suitable device or mechanism capable of receiving or transferring energy. One or more human-sized "squirrel cages" or treadmills (not shown) can also be provided to allow play participants to generate sufficient kinetic energy to operate a pump or conveyer or one or more other play elements. In such embodiments, the play participants can advantageously supply at least a portion of the actuating power or kinetic energy needed to operate each of the play elements and/or to achieve the final desired effect. Of course, those skilled in the art will readily recognize that extrinsic power sources can also be used to provide some or all of the energy needed to operate a particular play element or create a desired effect.

Furthermore, the skilled artisan will recognize the interchangeability of various features from different embodiments disclosed herein. Similarly, the various features and steps discussed above, as well as other known equivalents for each such feature or step, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events or simultaneous occurrence of the events, may be utilized in practicing the embodiments of the invention.

Further descriptions of apparatus and methods useable with embodiments of the present invention are available in the following U.S. patents and patent applications, each of which is incorporated herein by reference in its entirety: U.S. Pat. No. 5,194,048, issued Mar. 16, 1993; U.S. Pat. No. 5,865,680, issued Feb. 2, 1999; and U.S. patent application Ser. No. 11/376,570, filed on Mar. 15, 2006, published as U.S. Patent Publication No. 2006-0229134 A1 on Oct. 12, 2006.

While certain embodiments of the inventions have been described, these embodiments have been presented by way of example only, and are not intended to limit the scope of the disclosure. Indeed, the novel methods and systems described herein may be embodied in a variety of other forms; furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure.

What is claimed is:

1. An apparatus for providing water play entertainment to one or more play participants, the apparatus comprising:

an elongated substantially vertical structure having a top portion and a bottom portion and a substantially vertical, hollow guide extending therebetween wherein the bottom portion of the elongated substantially vertical structure is unenclosed, and the vertical hollow guide is not water-filled;

a water play effect located proximate to the bottom portion of the elongated substantially vertical structure;

a cannonball comprising a substantially spherical object with a diameter of between approximately three feet and approximately six feet, the cannonball being further configured to enter the elongated substantially vertical structure at the top portion and descend through the substantially vertical guide to the bottom portion, the cannonball being further configured to activate the water play effect when near the bottom portion of the elongated substantially vertical structure; and a return conduit configured to automatically transport the cannonball against a gravitational force from the bottom portion of the elongated substantially vertical structure to the top portion of the elongated substantially vertical structure following the descent of the cannonball.

2. The apparatus of claim 1, wherein the water play effect comprises a pool of water.

3. The apparatus of claim 2, wherein the cannonball is configured to radially displace the water from the pool when activating the water play effect.

4. The apparatus of claim 1, wherein the substantially vertical structure is at least partially transparent.

5. The apparatus of claim 1, wherein the return conduit comprises a tubular structure.

6. The apparatus of claim 5, wherein the return conduit comprises an auger within the tubular structure.

7. The apparatus of claim 1, wherein the substantially spherical object comprises a weight of at least approximately 750 pounds.

8. The apparatus of claim 1, wherein the water play effect comprises a computer-generated effect.

9. The apparatus of claim 1, wherein the water play effect comprises a plurality of nozzles configured to project water from the apparatus when the water play effect is activated.

10. The apparatus of claim 1, wherein the elongated substantially vertical structure comprises a helical shape.

11. The apparatus of claim 1, wherein the return conduit comprises a plurality of interconnected sections.

12. A method of providing an interactive water play apparatus, the method comprising:

providing a plurality of play media;

providing one or more guide elements configured to guide each of the plurality of play media along a travel path;

providing a water effect having a cannonball object; and providing at least one user-interactive control module communicatively coupled to the one or more guide elements to, based at least upon one or more actions of a user, alter the travel path of at least one of the plurality of play media to release the cannonball to activate the water effect, wherein the at least one control module provides one or more physical challenges to be completed by one or more play participants, and wherein the one or more guide elements comprise a default path and a secondary path, and wherein the at least one control module is configured to selectively alter the travel path of the at least one of the plurality of play media from the default path to the secondary path.

13. The method of claim 12, wherein providing the water effect comprises providing a substantially vertical structure for defining at least a portion of a descent path of the cannonball object.

14. The method of claim 13, additionally comprising providing a conduit configured to return the cannonball object to a top portion of the substantially vertical structure after the descent of the cannonball object.

15. The method of claim 12, wherein the plurality of play media comprises a plurality of balls.

16. A water play apparatus comprising:

means for containing water;

means for displacing the water from said containing means;

means for defining a substantially vertical guide substantially above said containing means, wherein said displacing means is configured to descend from a first portion of said defining means and through said defining means to the containing means;

means for triggering the descent of said displacing means; and means for returning said displacing means to the first portion of said defining means after a descent of said displacing means.

17. The water play apparatus of claim 16, wherein said triggering means comprises means for providing at least one interactive challenge to a plurality of play participants.

18. An apparatus for providing water play entertainment to one or more play participants, the apparatus comprising:

an elongated substantially vertical structure having a top portion and a bottom portion and a substantially vertical guide extending therebetween;

a water play effect located proximate to the bottom portion of the elongated substantially vertical structure;

a cannonball configured to enter the elongated substantially vertical structure at the top portion and descend through the substantially vertical guide to the bottom portion, the cannonball being further configured to activate the water play effect when near the bottom portion of the elongated substantially vertical structure; and a return conduit comprising a tubular structure and an auger within the tubular structure configured to transport the cannonball from the bottom portion of the elongated substantially vertical structure to the top portion of the elongated substantially vertical structure following the descent of the cannonball.

19. An apparatus for providing water play entertainment to one or more play participants, the apparatus comprising:

an elongated substantially vertical structure having a top portion and a bottom portion and a substantially vertical guide extending therebetween;

a water play effect located proximate to the bottom portion of the elongated substantially vertical structure, wherein the water play effect comprises a computer-generated effect;

a cannonball configured to enter the elongated substantially vertical structure at the top portion and descend through the substantially vertical guide to the bottom portion, the cannonball being further configured to activate the water play effect when near the bottom portion of the elongated substantially vertical structure; and a return conduit configured to transport the cannonball from the bottom portion of the elongated substantially vertical structure to the top portion of the elongated substantially vertical structure following the descent of the cannonball.

20. An apparatus for providing water play entertainment to one or more play participants, the apparatus comprising:

an elongated substantially vertical structure having a top portion and a bottom portion and a substantially vertical guide extending therebetween;

a water play effect located proximate to the bottom portion of the elongated substantially vertical structure, wherein the water play effect comprises a plurality of nozzles configured to project water from the apparatus when the water play effect is activated;

a cannonball configured to enter the elongated substantially vertical structure at the top portion and descend through the substantially vertical guide to the bottom portion, the cannonball being further configured to activate the water play effect when near the bottom portion of the elongated substantially vertical structure; and a return conduit configured to transport the cannonball from the bottom portion of the elongated substantially vertical structure to the top portion of the elongated substantially vertical structure following the descent of the cannonball.

* * * * *